US010407196B2

(12) United States Patent
Slurink

(10) Patent No.: US 10,407,196 B2
(45) Date of Patent: Sep. 10, 2019

(54) FILLING STATION AND METHOD FOR FILLING CARTRIDGES OF ELECTRONIC CIGARETTES WITH A LIQUID

(71) Applicant: Sluis Cigar Machinery B.V., Kampen (NL)

(72) Inventor: Oscar Slurink, Heino (NL)

(73) Assignee: SLUIS CIGAR MACHINERY B.V., Kampen (NL)

( * ) Notice: Subject to any disclaimer, the term of this patent is extended or adjusted under 35 U.S.C. 154(b) by 95 days.

(21) Appl. No.: 15/578,462

(22) PCT Filed: Jun. 1, 2016

(86) PCT No.: PCT/NL2016/050392
§ 371 (c)(1),
(2) Date: Nov. 30, 2017

(87) PCT Pub. No.: WO2016/200253
PCT Pub. Date: Dec. 15, 2016

(65) Prior Publication Data

US 2018/0134429 A1 May 17, 2018

(30) Foreign Application Priority Data

Jun. 9, 2015 (NL) ..... 2014946

(51) Int. Cl.
*B65B 39/12* (2006.01)
*B65B 35/46* (2006.01)
(Continued)

(52) U.S. Cl.
CPC ..... *B65B 39/12* (2013.01); *B65B 3/003* (2013.01); *B65B 3/04* (2013.01); *B65B 35/46* (2013.01);
(Continued)

(58) Field of Classification Search
CPC ..... B65B 39/12; B65B 35/46; B65B 3/04; B65B 3/003; B65B 59/04; B65B 59/00; B65B 2210/02; B65B 2039/009
See application file for complete search history.

(56) References Cited

U.S. PATENT DOCUMENTS 5,305,809 A * 4/1994 Pringle ..... B67C 3/26 141/157

FOREIGN PATENT DOCUMENTS

| | | |
|---|---|---|
| DE | 10152234 A1 | 7/2003 |
| EP | 2639163 A1 | 9/2013 |
| GB | 2323081 A | 9/1998 |

OTHER PUBLICATIONS

International Search Report and Written Opinion dated Oct. 26, 2016 for Application No. PCT/NL2016/050392.
(Continued)

*Primary Examiner* — Jason K Niesz
(74) *Attorney, Agent, or Firm* — Patterson + Sheridan, LLP

(57) ABSTRACT

The present invention relates to a filling station for filling cartridges of electronic cigarettes with a liquid, the filling station defining a plurality of filling positions for a plurality of cartridges, the filling station being configured for simultaneously filling the cartridges which are in the filling positions, the filling station comprising: a plurality of nozzles, wherein the nozzles are grouped in a first group of first nozzles and a second group of second nozzles, wherein each filling position is associated with a first nozzle from the first group and a second nozzle from the second group, an up-down actuator for moving the nozzles downward into upwardly oriented filling openings of the cartridges in the filling positions in order to insert at least a first nozzle and a second nozzle into each cartridge, and a distance actuator
(Continued)

for changing a horizontal distance between each first nozzle and second nozzle.

20 Claims, 14 Drawing Sheets

(51) Int. Cl.

| | |
|---|---|
| ***B65B 59/00*** | (2006.01) |
| ***B65B 59/04*** | (2006.01) |
| ***B65B 3/00*** | (2006.01) |
| ***B65B 3/04*** | (2006.01) |
| *B65B 39/00* | (2006.01) |

(52) U.S. Cl.
CPC ..... *B65B 59/00* (2013.01); *B65B 59/04* (2013.01); *B65B 2039/009* (2013.01); *B65B 2210/02* (2013.01)

(56) References Cited

OTHER PUBLICATIONS

Search Report and Written Opinion dated Jan. 25, 2016 for Netherland Application No. NL2014946.

* cited by examiner

FILLING STATION AND METHOD FOR FILLING CARTRIDGES OF ELECTRONIC CIGARETTES WITH A LIQUID

FIELD OF THE INVENTION

The present invention relates to a filling station and method for filling cartridges of electronic cigarettes with a liquid. Filling stations and filling methods for filling cartridges of electronic cigarettes are known.

BACKGROUND OF THE INVENTION

Cartridges for electronic cigarettes are generally filled in a filling line. Generally, the cartridges contain a wad (also referred to as a "non-woven"). During the filling, the wad is impregnated with the liquid. The liquid may contain nicotine, aromas and various other substances.

The cartridges are generally filled by directing the open top end upward and filling the cartridge with a predetermined volume of the liquid. The filling itself may be difficult and time-consuming. This is partly due to the fact that the liquid substance which is injected into the cartridge has to impregnate the wad, which is a relatively slow process. The time-consuming nature is also due to the viscous nature of the liquid itself. The liquid generally has a high viscosity and density, which slows down its movement.

As a result, currently used filling devices of cartridges for electronic cigarettes are relatively slow and rather cumbersome.

To speed up the filling process, WO2015040568A1 proposes a filling device having metering chambers. It was found that this in itself is a complex and cumbersome method of filling the cartridges.

A further challenge in filling cartridges of electronic cigarettes is that the cartridges may have varying sizes. In particular the diameter of the cartridges may vary. A single filling line is generally used for cartridges of multiple sizes. When a series of cartridges of a different diameter must be filled, the filling line is converted. In order to limit the downtime, the conversion should be quite fast. It has been found quite challenging in practice to convert the filling line fast. In practice, a considerable down time of the filling line generally occurs for a conversion from one diameter to another diameter, which is disadvantageous.

OBJECT OF THE INVENTION

It is a first objective of the invention to provide a filling device which enables relatively fast and reliable filling of cartridges for electronic cigarettes.

It is second objective of the invention to provide a filling device which can be adapted to cartridges of varying size, in particular a varying diameter, in a reliable manner and within a short period of time.

It is yet a further objective to achieve both the first and second objective in a single apparatus and method.

THE INVENTION

In order to achieve at least one objective, a filling station for filling cartridges of electronic cigarettes with a liquid is provided, the filling station defining a plurality of filling positions for a plurality of cartridges, the filling station being configured for simultaneously filling the cartridges which are in the filling positions, the filling station comprising:

a plurality of nozzles, wherein the nozzles are grouped in:
- a first group of first nozzles and
- a second group of second nozzles, wherein each filling position is associated with a first nozzle from the first group and a second nozzle from the second group, an up-down actuator for moving the nozzles downward into upwardly oriented filling openings of the cartridges in the filling positions in order to insert at least a first nozzle and a second nozzle into each cartridge, and a distance actuator for changing a horizontal distance between each first nozzle and second nozzle.

By using multiple nozzles per cartridge, the filling can take place faster and more evenly.

It is a risk during the filling of the cartridges that the nozzles collide with the upper rim of the cartridge during their downward movement. This is due to the fact that the size of the openings of the cartridges are relatively small. Any deviation in the position of the cartridge or the position of the nozzle may lead to the nozzle hitting the cartridge on the way down. This may result in a non-filled cartridge and damage to the nozzle. With two nozzles (or more) which are positioned at a distance from one another, the risk of collision is even greater.

The adjustment of the distance between the first and second needles makes it possible to avoid collisions with the cartridges.

The possibility to vary the distance also makes it possible to position the nozzles in a preferred location inside the cartridges during the filling.

In an embodiment:

the up-down actuator (38) is configured to move the first and second group of nozzles into and out of the cartridges, and the distance actuator (39) is configured to increase and decrease the distance between the respective first nozzles and second nozzles while they are inserted into the cartridges.

With this embodiment, the risk of collision has been further mitigated by inserting the nozzles relatively close to one another into the cartridge, followed by increasing the distance between the nozzles. Subsequently, the cartridge is filled.

In an embodiment, the up-down actuator is configured to further move the first and second group of nozzles into the cartridges after the distance between the respective first nozzles and second nozzles has been increased by the distance actuator. The up-down actuator and the distance actuator may be configured to insert the respective first and second nozzle into each cartridge between the wall of the cartridge and a wad which is located inside the cartridge. This allows direct injection of the liquid into the wads from both nozzles.

In an embodiment, the first and second nozzle are inserted on opposite sides of the cartridge. This creates an effective filling of the cartridge and the wad inside the cartridge. The plurality of nozzles makes it easier to completely fill the wad in a limited amount of time.

The up-down actuator and the distance actuator may be configured to—after the filling of the cartridges, decrease the distance (D) between the respective first nozzles and second nozzles while they are still inserted in the cartridges and to subsequently retract the first and second group of nozzles upwards and out of the cartridges. This creates a simple cycle for the movement of the nozzles and prevent the nozzles from contacting the ridge of the cartridge which surrounds the opening.

The up-down actuator and the distance actuator may be configured to—after the filling of the cartridges, retract the respective first nozzles and second nozzles partially from the cartridges and to subsequently decrease the distance between the respective first nozzles and second nozzles. In this way damage to the wad is substantially limited or prevented.

In an embodiment, the up-down actuator and the distance actuator are configured to fully retract the respective first nozzles and second nozzles from the cartridges after the distance between the respective first nozzles and second nozzles has been decreased.

In an embodiment, the filling station comprises an overhead beam which extends above the filling area, wherein a rail is mounted to said overhead beam, and wherein the common first and second support members are connected to said rail via sliders and are movable from left to right and vice versa. It was found that this embodiment provides great reliability.

In an embodiment, the nozzles of the first group are mounted to a common first support member and the nozzles of the second group are mounted to a common second support member, wherein the first and second common support member are moveable relative to one another over a horizontal distance. It was found that this forms a simple and reliable mechanism.

The second common support member may be located vertically above the first common support member and may slide over the first support member.

The nozzles may have a needle shape, comprising an opening or an inclined surface, wherein the opening or inclined surface of each first nozzle faces the opening or inclined surface of the associated second nozzle for each filling position. This allows direct injection into the wad in the inserted position. In another embodiment, the nozzle may have a needle shape with a closed inclined bottom surface, and with the opening in the side wall instead of being provided in the inclined bottom surface. This allows a more sideways oriented filling of the liquid, into the wad. The inclined surface ensures that the nozzle does not penetrate the wad but remains between the wad and the side wall.

Each nozzle may have a lower tip which is located eccentrically with respect to a main axis of the said nozzle and wherein when the nozzle is in the inserted position the lower tip of each nozzle is closer to a side wall of the cartridge than the main axis of each nozzle. It was found that in this arrangement the injection of the liquid into the wad is most effective.

The filling station may be configured to simultaneously insert all nozzles into the filling openings of the cartridges situated in the filling positions.

When seen in top view the filling locations may be arranged along a part of a circle and the nozzles are arranged along a part of a same or similar circle in order to match with the arrangement of the filling locations. This allows a rotary arrangement for the filling which was found to be very effective and reliable.

The filling station may comprise a rotary conveyor for revolving the cartridges around a central axis, the rotary conveyor being supported by a support frame, the rotary conveyor comprising an entry area where the cartridges enter the rotary conveyor, a filling area where the filling locations are provided and an exit area where the cartridges leave the rotary conveyor. This arrangement was fond to be very reliable and effective.

The present invention further relates to a method of filling cartridges for electronic cigarettes, the method comprising:

- providing the filling station according to the invention,
- positioning a number of cartridges in the respective filling locations,
- inserting the nozzles of the first and second group into the respective cartridges,
- filling each cartridge by ejecting a liquid through the respective first and second nozzles, and
- retracting the nozzles from the cartridges, wherein the method comprises changing the distance between the respective nozzles of the first group and the respective nozzles of the second group.

The method provides the same advantages as the filling station according to the invention The method may comprise:

- inserting the nozzles into the cartridges, wherein the respective first and second nozzle for each filling position are positioned at first distance (D1) from one another,
- increasing the distance between the first and second nozzles to a second distance (D2) when the nozzles are in the inserted position, and
- inserting the nozzles further to a deepest position.

The method may further comprise inserting the nozzles further into the cartridges after the distance has been increased. The method may comprise inserting each nozzle into the cartridge between the side wall of the cartridge and the wad.

The method may further comprise decreasing the distance between the respective first and second nozzles after the filling of the cartridges and prior to retracting of the nozzles fully from the cartridges.

The nozzles may be moved upwardly during the filling in order to fill the wads substantially evenly.

The method may comprise:

- providing the filling station according to the invention which are directed at the filling station,
- filling a number of cartridges of a first size, wherein the respective first and second nozzles are positioned at a first distance from one another during the filling,
- adjusting the filling station by changing the distance between the nozzles from the first distance to a second distance, and
- filling a number of cartridges of a second size, wherein the respective first and second nozzles are positioned at the second distance from one another during the filling.

This effectively allows filling cartridges of different size with the same filling station without a long downtime.

In an embodiment of the method, the first distance is smaller than a first diameter of the cartridges of the first size, and the second distance is smaller than a second diameter of the cartridges of the first size.

In an embodiment of the method, the first and second group of nozzles are simultaneously inserted into the openings of the respective cartridges. This is fast and simple.

These and other aspects of the invention will be more readily appreciated as the same becomes better understood by reference to the following detailed description and considered in connection with the accompanying drawings in which like reference symbols designate like parts.

DETAILED DESCRIPTION OF THE FIGURES

Figure 1:
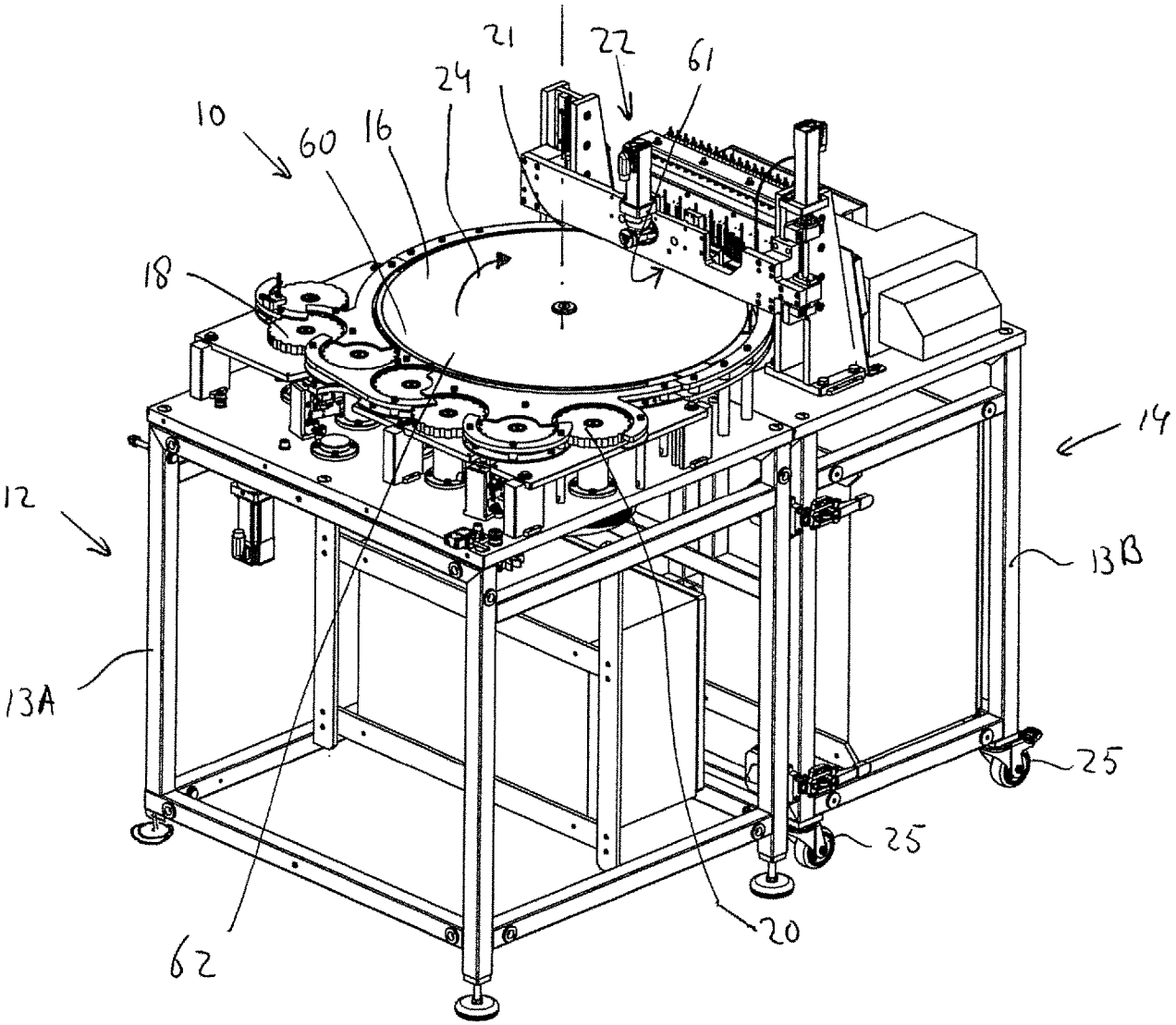
FIG. 1 shows an isometric view of a filling station according to the present invention.
Figure 2A:
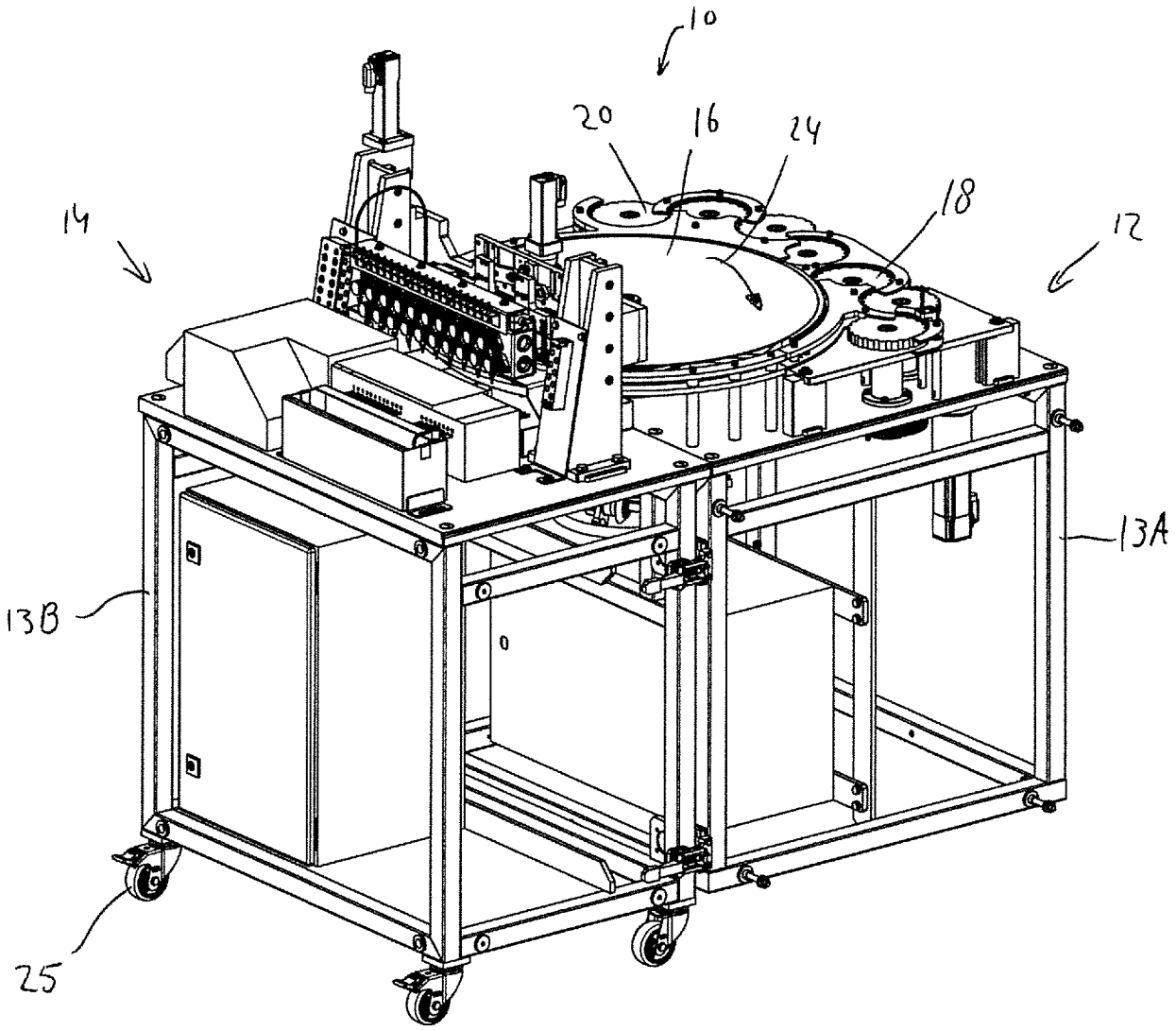
FIG. 2A shows an isometric view of the filling station according to the present invention from a different angle.
Figure 2B:
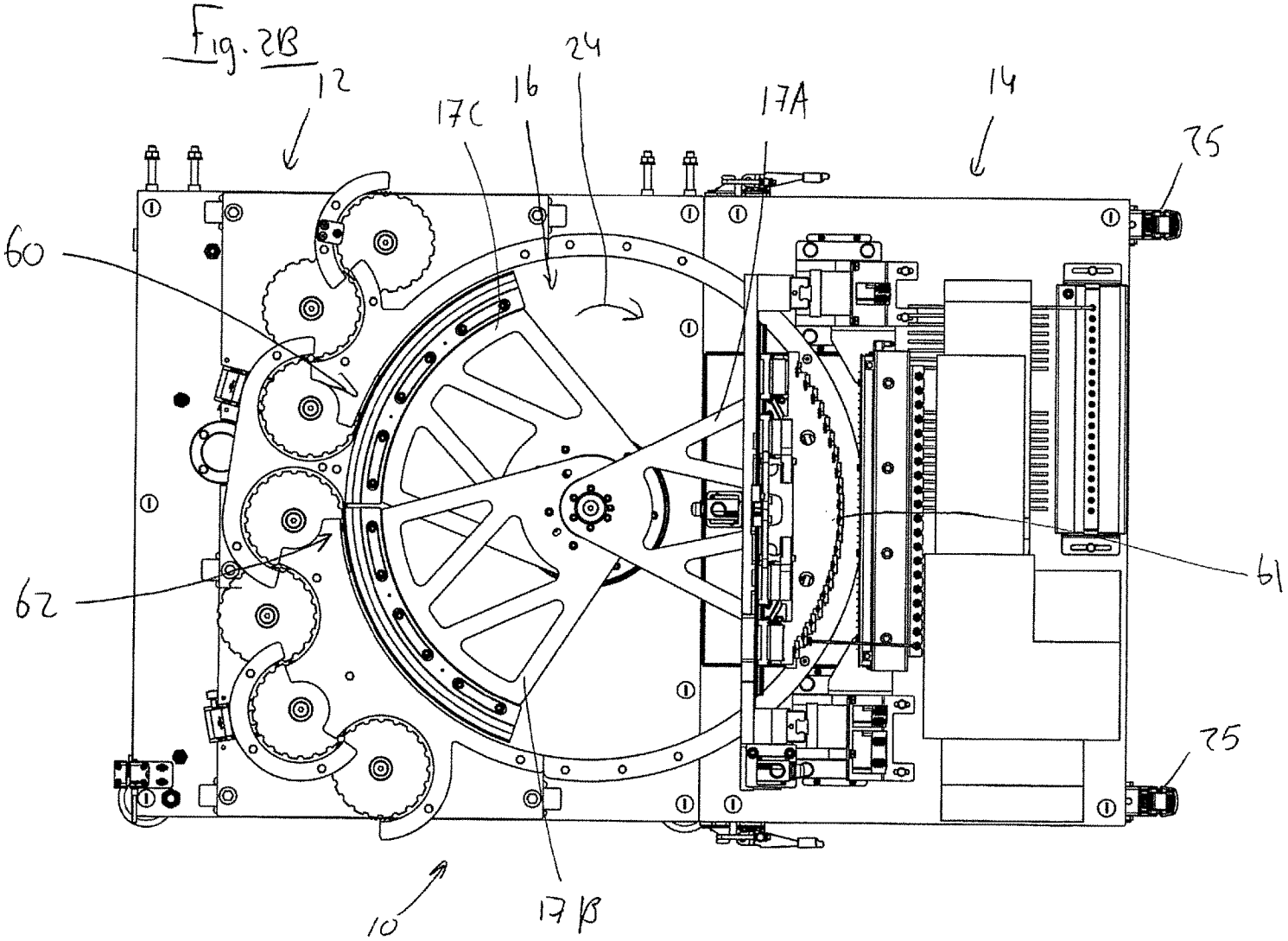
FIG. 2B shows a top view of the filling station according to the present invention.
Figure 8:
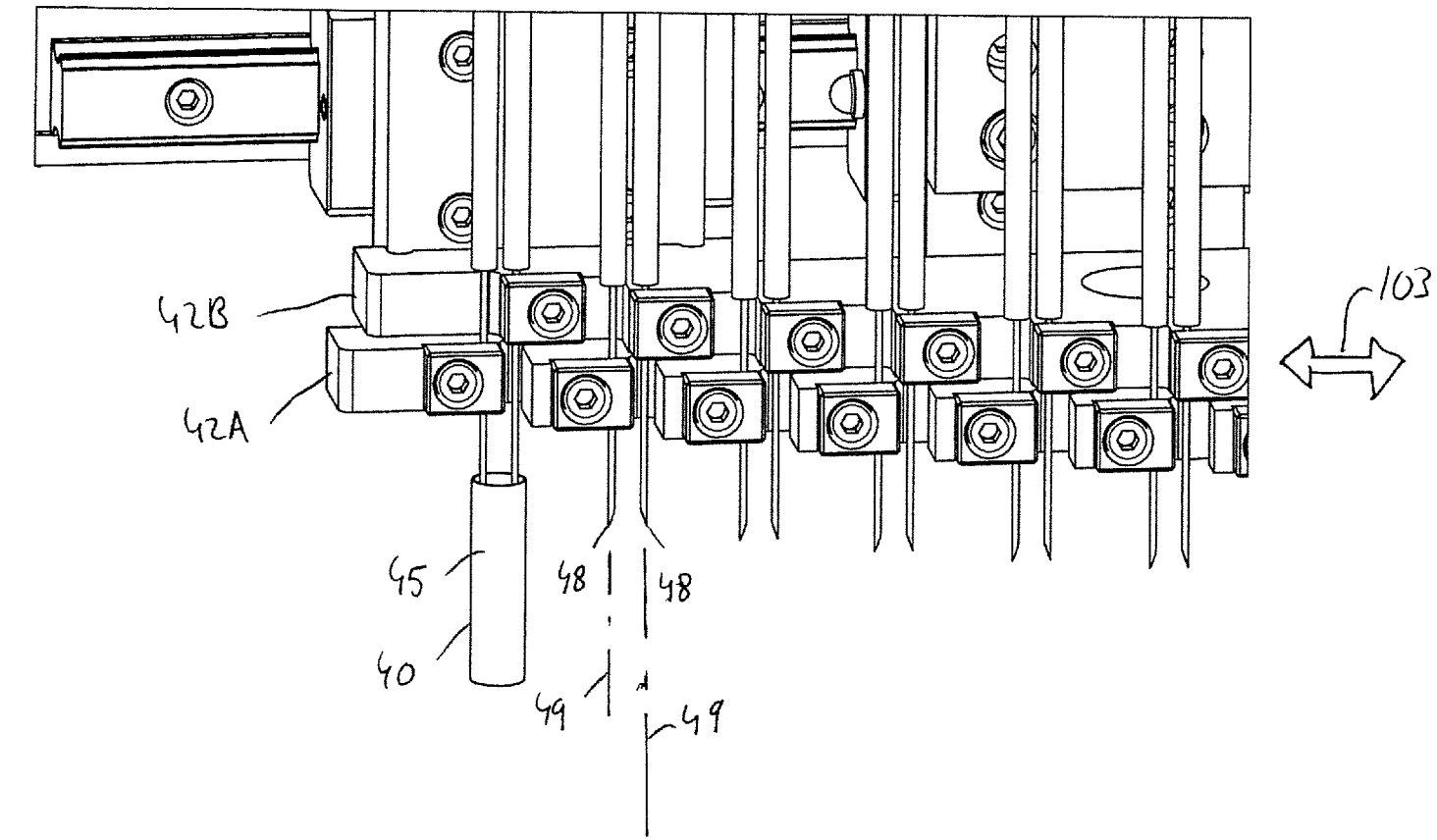
FIG. 8 shows a detail of FIG. 6 including a cartridge and in a second stage.

Turning to FIGS. 1, 2A and 2B, a filling station 10 for filling cartridges of electronic cigarettes with a liquid is shown. A cartridge 40 is shown in FIG. 8 and will be discussed further below. Returning to FIG. 1, the filling station is intended to form part of a filling line.

The filling station comprises two parts, a permanent part 12 and an exchangeable part 14 . Both parts comprise a frame 13A resp. 13B.

The permanent part 12 comprises a rotary conveyor 16, an infeed device 18 and an outfeed device 20. The rotary conveyor moves the cartridges around a central axis 21. The rotary conveyor comprising an entry area 60 where the cartridges enter the rotary conveyor, a filling area 61 where the filling locations are provided and an exit area 62 where the cartridges leave the rotary conveyor. The cartridges are conveyed in groups.

In use, a group of cartridges 40 are positioned in the respective filling locations 30 of the filling area 61 by the rotary conveyor.

The exchangeable part 14 comprises a filling unit 22 which is positioned overhead the rotary conveyor 16. The rotary conveyor receives a group of cartridges from the infeed device 18. The rotary conveyor subsequently moves the group in the direction 24 to a filling area 61 underneath the filling unit 22. The filling area comprises twenty filling positions. A different number is also possible. The filling positions are discussed in more detail further below. Subsequently the cartridges are filled. Next, the group of cartridges is moved to the outfeed device 20, where the cartridges are removed from the rotary conveyor.

The exchangeable part 14 is provided with wheels 25 in order to be exchanged for a similar exchangeable part. However, this is not essential to this invention. The exchangeable part could also be non-exchangeable and integrated with the permanent part.

Turning to FIG. 2B, the rotary conveyor 16 comprises three "pizza-slice" segments 17A, 17B, 17C which each hold a group of cartridges and rotate about the main axis 21.

Figure 3:
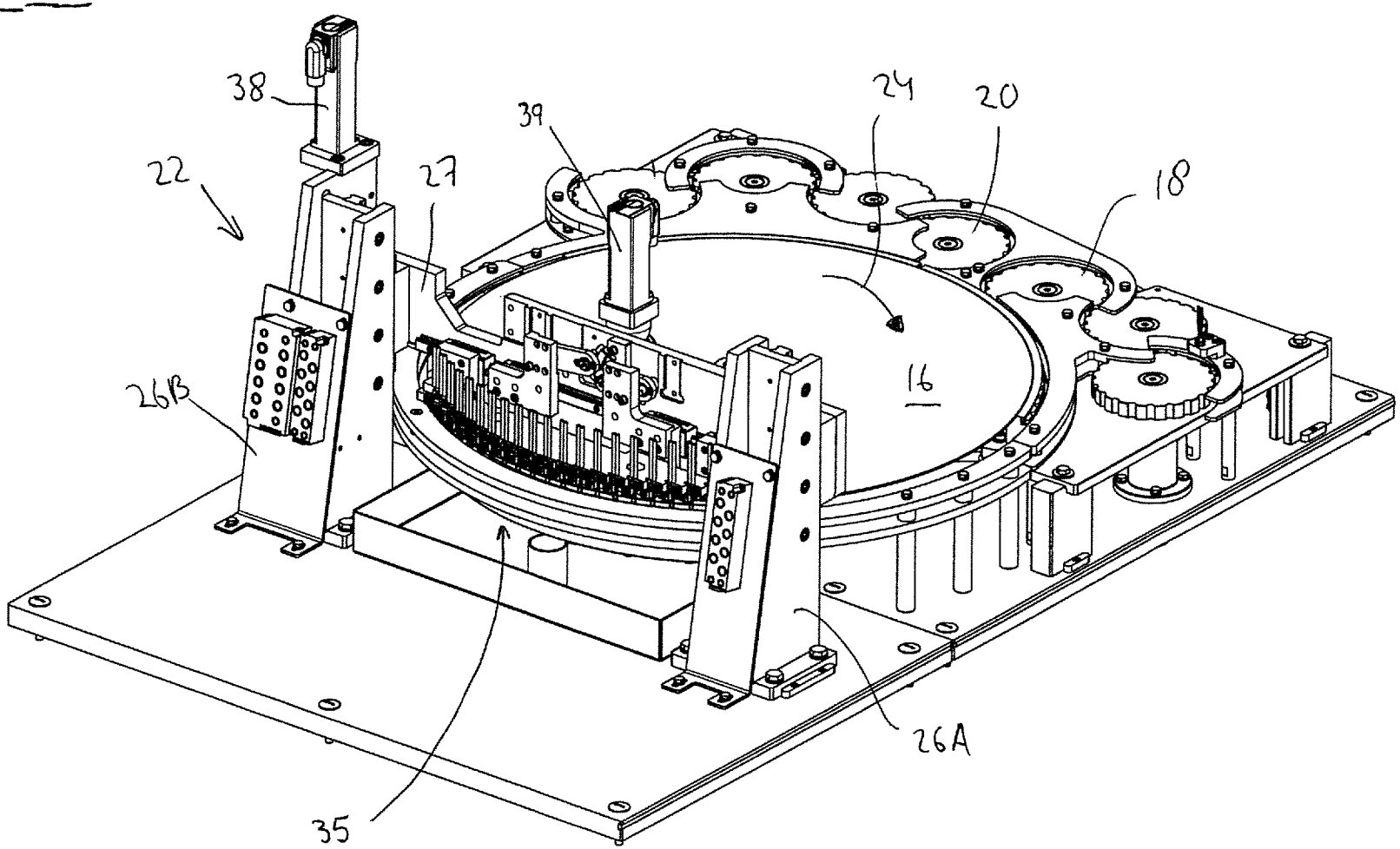
FIG. 3 shows a partial isometric view of the filling station according to the present invention from a different angle.
Figure 4:
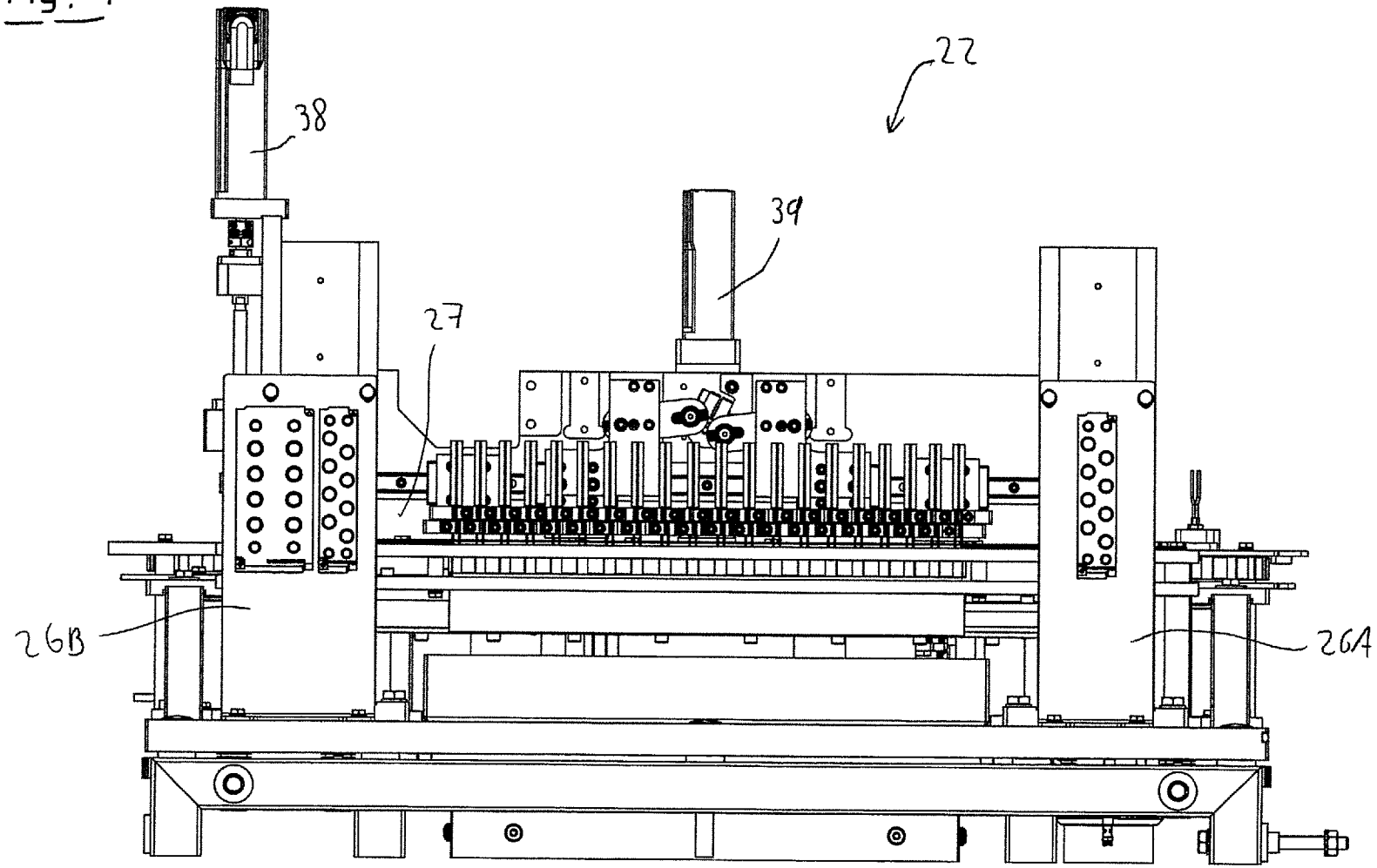
FIG. 4 shows a partial front view of the filling station according to the present invention.
Figure 5:
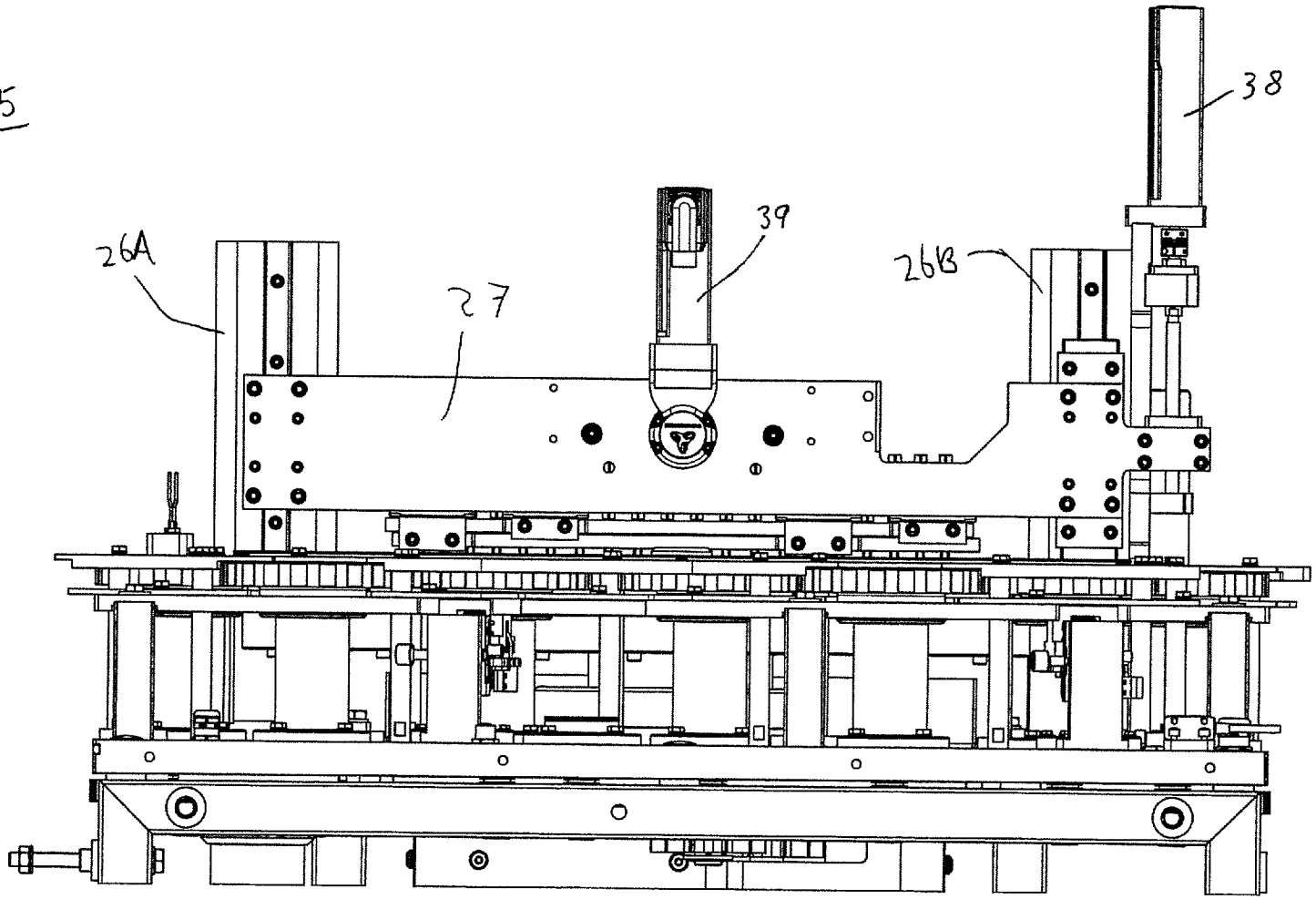
FIG. 5 shows a partial back view of the filling station according to the present invention.

Turning to FIGS. 3, 4 and 5, the filling unit 22 is shown in more detail. The filling unit comprises two posts 26A, 26B and a horizontal beam 27. The posts 26A, 26B are positioned just outside the rotary conveyor 16. The beam 27 is supported by the posts 26A, 26B and is positioned above the rotary conveyor 16. The beam supports a plurality of nozzles 35.

The filling station further comprises an up-down actuator 38 for moving the nozzles 35 downward, into upwardly oriented filling openings of the cartridges in the filling positions 30. The up-down actuator is positioned on the post 26B. The up-down actuator 38 is an electric linear actuator but other types may also be used. The up-down actuator moves all nozzles downward simultaneously in order to insert a first nozzle and a second nozzle into each cartridge. All nozzles are inserted simultaneously.

Figure 6:
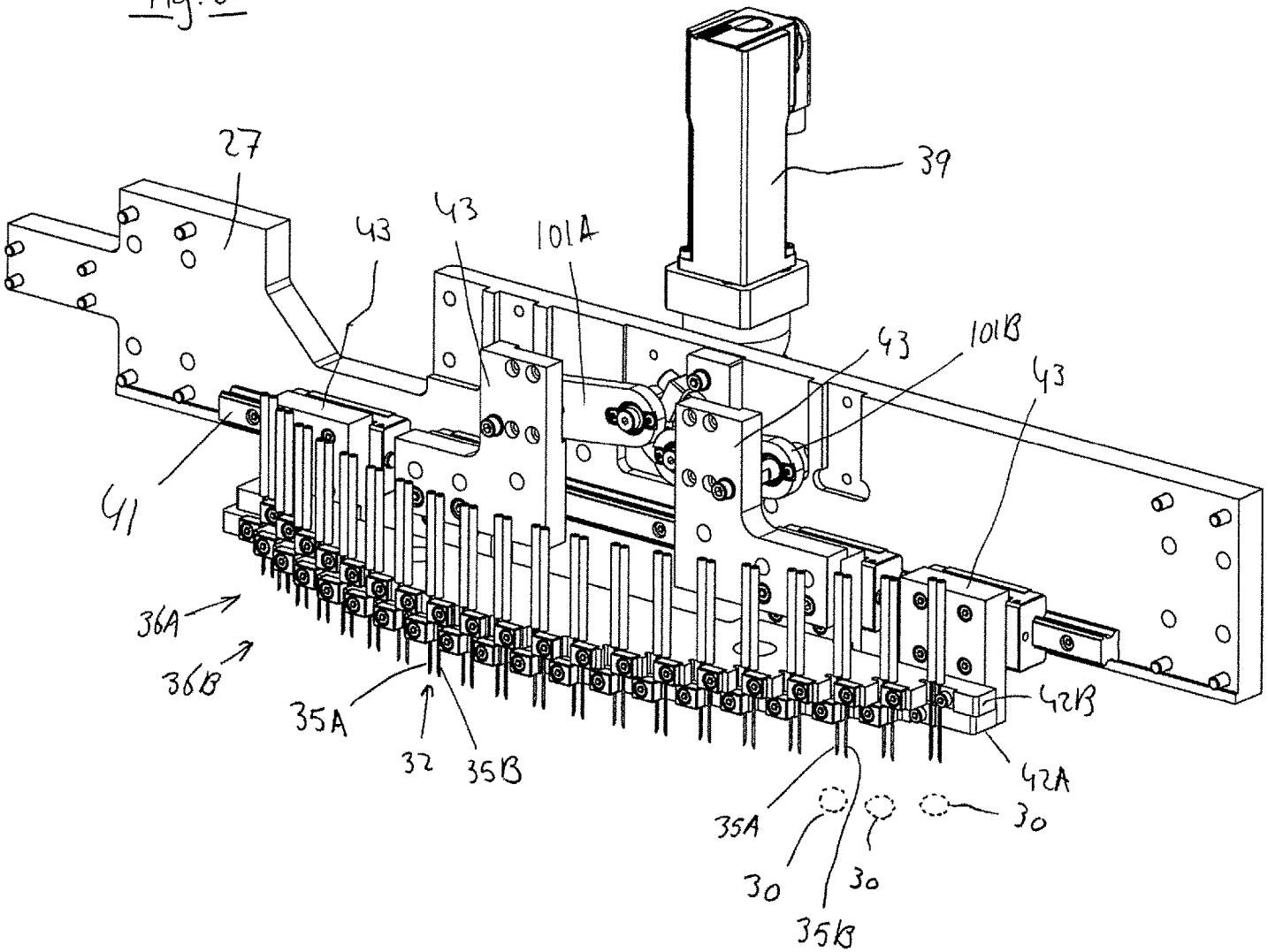
FIG. 6 shows a partial isometric view of an arrangement of nozzles according to the present invention.
Figure 7:
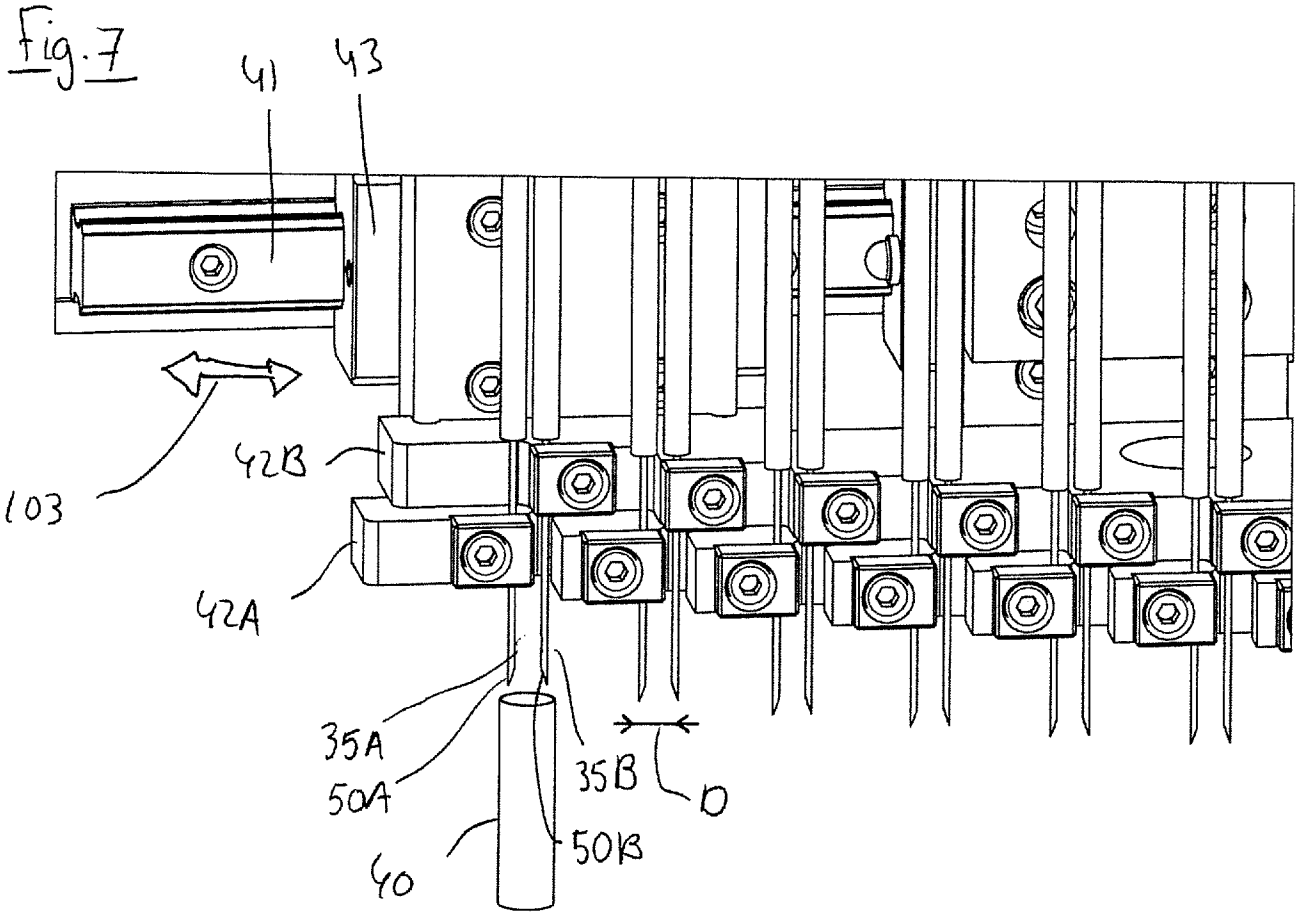
FIG. 7 shows a detail of FIG. 6 including a cartridge and in a first stage.

Turning to FIGS. 6, 7 and 8, a part of the filling unit is shown. The filling unit 22 has twenty pairs 32 of nozzles 35. In top view, the pairs 32 are arranged as a part of a circle which matches the size and shape of the rotary conveyor 16. The filling station 10 defines twenty filling positions 30 for a plurality of cartridges. The cartridges are filled simultaneously. Three filling positions 30 are shown in FIG. 6. Obviously, the filling station 10 could also have a different number of filling positions than twenty.

Each nozzle pair 32 has a left nozzle 35A and a right nozzle 35B, also indicated as a first nozzle 35A and a second nozzle 35B. The nozzles are also collectively indicated by numeral 35. The nozzles are grouped in a first group 36A of first nozzles 35A and a second group 36B of second nozzles 35B. The first group 36A and second group 36B are indicated schematically in FIG. 6.

Each filling position 30 is associated with a first nozzle 35A from the first group and a second nozzle 35B from the second group.

The nozzles have a shape which is somewhat similar to the shape of hypodermic needle, wherein the opening 50A of each first nozzle faces the opening 50B of the associated second nozzle 35B for each filling position.

As indicate in FIG. 8, each nozzle has a lower tip 48 which is located eccentrically with respect to a main axis 49 of the said nozzle and wherein when the nozzle is in the inserted position the lower tip 48 of each nozzle is closer to a side wall of the cartridge than the main axis 49 of each nozzle.

The filling station further comprises a distance actuator 39 for changing a horizontal distance (D) between each first nozzle 35A and second nozzle 35B. The distance actuator is an electric linear actuator, but other actuators may be used.

The up-down actuator 38 and the distance actuator 39 are configured to move the first group 36A and second group 36B of nozzles into the cartridges, and to increase the distance between the respective first nozzles and second nozzles when they are inserted into the cartridges.

The up-down actuator 38 is configured to further move the first and second group of nozzles into the cartridges after the distance between the respective first nozzles and second nozzles has been increased.

The first group 36A of first nozzles are mounted on a common first support member 42A. The second group of nozzles 36B are mounted on a common second support member 42B. The first and second support members 42A, 42B are movable relative to one another over a horizontal distance. The first and second support members 42A, 42B are connected to a rail 41 via sliders 43 which slide along the rail 41 in the direction indicated by arrow 103. The rail 41 is mounted to the overhead beam 27. The second common support member 42B is located vertically above the first common support member 42A. The distance actuator 39 is coupled with the common support members 42A, 42B via two beams 101A, 101B and the sliders 43.

Turning to FIGS. 9A, 9B, 9C and 9D, the cartridge 40 is shown in more detail in a sectional view. The cartridge comprises a wad 44 or non-woven for holding the liquid. The wad has a tubular shape. The cartridge has an upper opening 46.

Figure 9A:
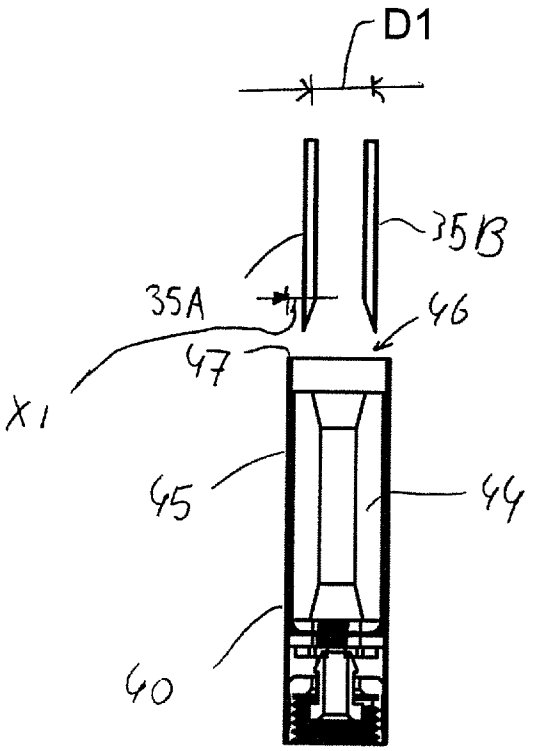
FIGS. 9A, 9B, 9C and 9D show a sequence of the movement of the nozzles relative to the cartridges in a sectional view.

Turning in particular to FIG. 9A, the up-down actuator and the distance actuator are configured to insert the respective first and second nozzle into each cartridge when the first and second nozzle are at a first distance D1 from one another.

The first distance D1 is small enough to ensure that the nozzles remain at a distance X1 from the side wall 45 of the cartridge. In this way, any collisions between the nozzles and the upper ridge 47 of the opening 46 are prevented.

Figure 9B:
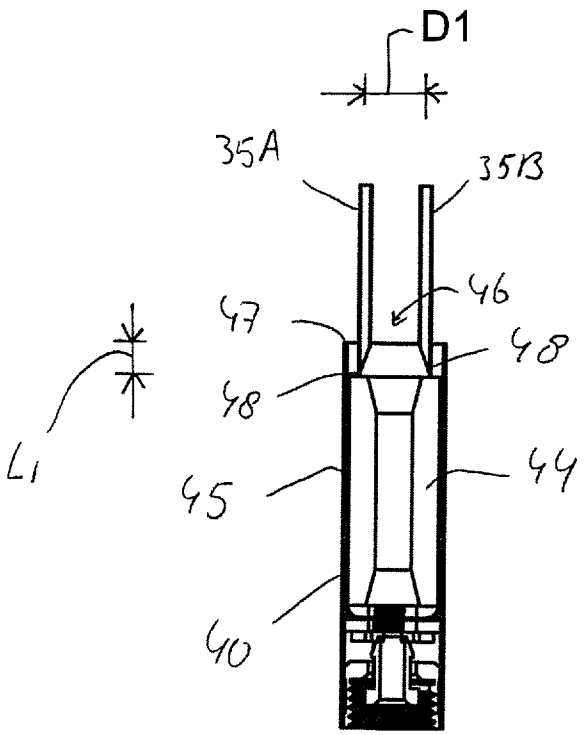

Turning to FIG. 9B, the situation is shown after the tips 48 of the nozzles 35A, 35B have been inserted into the cartridge 40 over a distance L1. The nozzles are in an intermediate position and not yet fully inserted. The distance between the nozzles is still D1, i.e. relatively small.

Figure 9C:
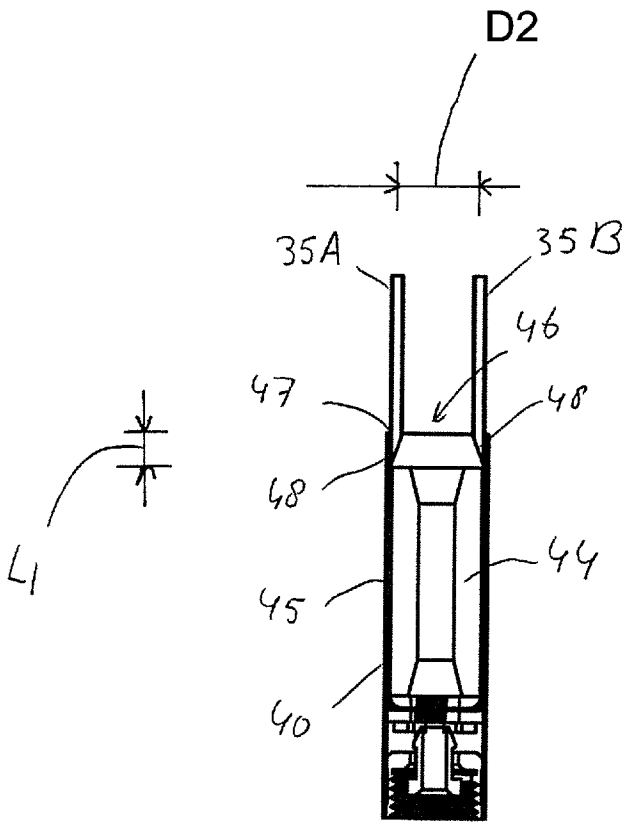

Subsequently, the distance is increase by the distance actuator 39 to the distance D2. This situation is shown in FIG. 9C. The nozzles 35A, 35B engage the wall 45 or have a very small distance to the wall 45. The first and second nozzle 35A, 35B are located on opposite sides of the cartridge.

Figure 9D:
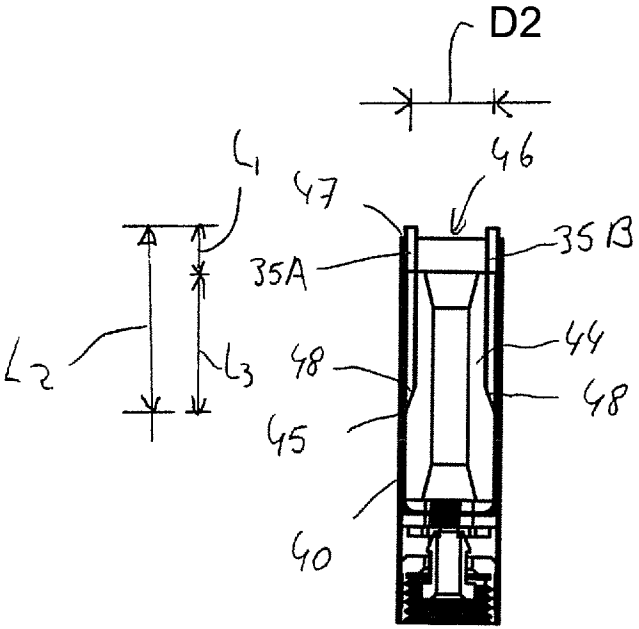

Turning to FIG. 9D, subsequently the nozzles 35A, 35B are further inserted into the cartridge to a deepest position, to a distance L2 which is greater than the distance L1. The difference between L1 and L2 is indicated as L3. The nozzles 35A, 35B are inserted between the wad 44 and the wall 45. In this position, the liquid is ejected from the nozzles. The liquid is ejected directly into the wad 44. All cartridges are filled simultaneously.

In an embodiment the needles are moving upward during the liquid flow to create an even liquid distribution in the wad.

After the filling of the cartridges, the nozzles 35A, 35B are retracted from the cartridge over a distance L2 from the deepest position. After the retraction of the needle width is decreased to D1.

Figure 10:
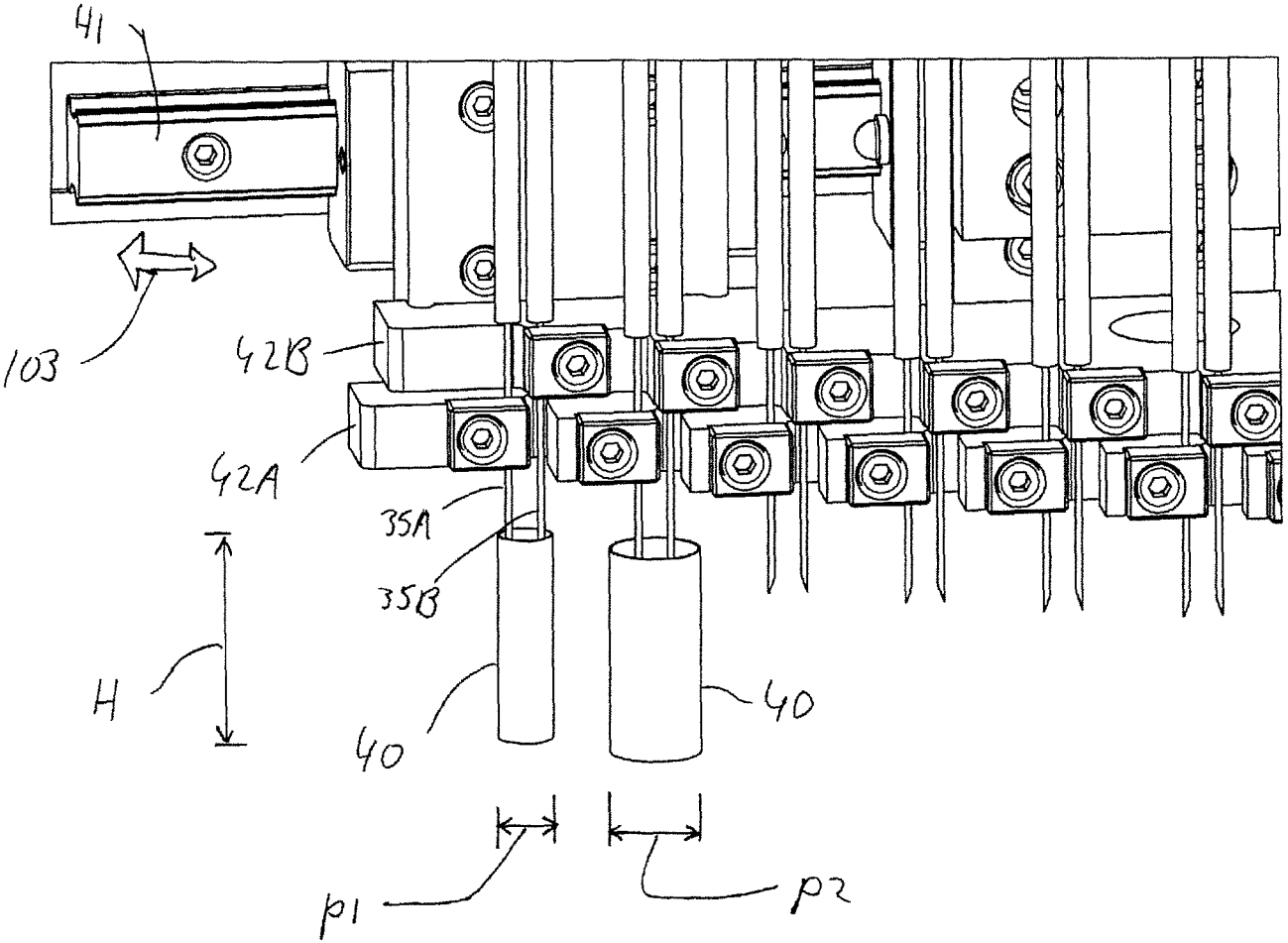
FIG. 10 shows nozzles in combination with cartridges of different diameters.

Turning to FIG. 10, the filling station 10 is also configured to fill cartridges of different diameters P1, P2. A cartridge 40 having a relatively small diameter P1 is shown and a cartridge having a relatively large diameter P2 is shown. The distance actuator 39 can be adjusted to vary the distances D1, D2 in case the diameter of the cartridge varies. This is a relatively simple and straightforward process.

Likewise, the up-down actuator 38 can also be adjusted to vary the distances L1 and L2 in case a height of the cartridge varies. This is a relatively simple and straightforward process. In this way, the filling station can be converted from one type of filling cartridge to another type of filling cartridge quite easily.

It will be understood that for each diameter and each length of the cartridge, a same kind of trajectory may be followed by the nozzles, i.e. inserting the nozzles to an intermediate position, increasing the distance between the nozzles and subsequently inserting the nozzles to the deepest position. The distances D1, D2, L1 and L2 may be adjusted for each type of nozzle. These distances may be pre-set in a control unit so that the conversion can be carried out fast and with little downtime.

It will be recognized that an embodiment may not achieve all of the stated objects.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting, but rather, to provide an understandable description of the invention.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language, not excluding other elements or steps). Any reference signs in the claims should not be construed as limiting the scope of the claims or the invention.

The mere fact that certain measures are recited in mutually different dependent claims does not indicate that a combination of these measures cannot be used to advantage.

The invention claimed is:

1. A filling station for filling cartridges of electronic cigarettes with a liquid, the filling station defining a plurality of filling positions for a plurality of cartridges, the filling station being configured for simultaneously filling the cartridges which are in the filling positions, the filling station comprising:

a plurality of nozzles, wherein the nozzles are grouped in a first group of first nozzles and a second group of second nozzles, wherein each filling position is associated with a first nozzle from the first group and a second nozzle from the second group;

an up-down actuator for moving the nozzles downward into upwardly oriented filling openings of the cartridges in the filling positions in order to insert at least a first nozzle and a second nozzle into each cartridge; and a distance actuator for changing a horizontal distance between each first nozzle and second nozzle.

2. The filling station according to claim 1, wherein the up-down actuator is configured to move the first and second group of nozzles into and out of the cartridges, and the distance actuator is configured to increase and decrease the distance between the respective first nozzles and second nozzles while they are inserted into the cartridges.

3. The filling station according to claim 2, wherein the up-down actuator is configured to further move the first and second group of nozzles into the cartridges after the distance between the respective first nozzles and second nozzles has been increased by the distance actuator.

4. The filling station according to claim 1, wherein the up-down actuator and the distance actuator are configured to insert the respective first and second nozzle into each cartridge between the wall of the cartridge and a wad which is located inside the cartridge, and wherein the first and second nozzles are inserted on opposite sides of the cartridge.

5. The filling station according to claim 1, wherein the up-down actuator and the distance actuator are configured to, after the filling of the cartridges, retract the respective first nozzles and second nozzles partially from the cartridges over a distance and to subsequently decrease the distance between the respective first nozzles and second nozzles.

6. The filling station according to claim 5, wherein the up-down actuator and the distance actuator are configured to fully retract the respective first nozzles and second nozzles from the cartridges after the distance between the respective first nozzles and second nozzles has been decreased.

7. The filling station according to claim 1, wherein the nozzles of the first group are mounted to a common first support member and the nozzles of the second group are mounted to a common second support member, wherein the first and second common support member are moveable relative to one another over a horizontal distance.

8. The filling station according to claim 7, further comprising an overhead beam which extends above the filling area, wherein a rail is mounted to said overhead beam, and wherein the common first and second support members are connected to said rail via sliders and are movable from left to right and vice versa.

9. The filling station according to claim 1, wherein the nozzles have a needle shape comprising an opening or an inclined surface, wherein the opening or inclined surface of each first nozzle faces the opening or inclined surface of the associated second nozzle for each filling position.

10. The filling station according to claim 1, wherein each nozzle has a lower tip which is located eccentrically with respect to a main axis of the said nozzle and wherein when the nozzle is in the inserted position the lower tip of each nozzle is closer to a side wall of the cartridge than the main axis of each nozzle.

11. The filling station according to claim 1, wherein the up-down actuator is configured to simultaneously insert all nozzles into the filling openings of the cartridges situated in the filling positions.

12. The filling station according to claim 1, wherein when seen in top view the filling locations are arranged along a part of a circle and the pairs of nozzles are arranged along a part of a same or similar circle in order to match with the arrangement of the filling locations.

13. The filling station according to claim 1, further comprising a rotary conveyor for revolving the cartridges around a central axis, the rotary conveyor being supported by a support frame, the rotary conveyor comprising an entry area where the cartridges enter the rotary conveyor, a filling area where the filling locations are provided, and an exit area where the cartridges leave the rotary conveyor.

14. A method of filling cartridges for electronic cigarettes, the method comprising:

providing the filling station according to claim 1;

positioning a number of cartridges in the respective filling locations;

inserting the nozzles of the first and second group into the respective cartridges;

filling each cartridge by ejecting a liquid through the respective first and second nozzles;

retracting the nozzles from the cartridges; and changing the distance between the respective nozzles of the first group and the respective nozzles of the second group.

15. The method according to claim 14, further comprising:

inserting the nozzles into the cartridges, wherein the respective first and second nozzle for each filling position are positioned at a first distance from one another;

increasing the distance between the first and second nozzles to a second distance when the nozzles are in the inserted position; and inserting the nozzles further to a deepest position.

16. The method according to claim 14, further comprising further inserting the nozzles into the cartridges after the distance has been increased.

17. The method according to claim 14, further comprising inserting each nozzle into the cartridge between the side wall of the cartridge and the wad.

18. The method according to claim 14, wherein the nozzles are moved upwardly during the filling in order to fill the wads substantially evenly.

19. A method of filling cartridges of electronic cigarettes, the method comprising:

providing the filling station according to claim 1;

filling a number of cartridges of a first size, wherein the respective first and second nozzles are positioned at a first distance from one another during the filling;

adjusting the filling station by changing the distance between the nozzles from the first distance to a second distance; and filling a number of cartridges of a second size, wherein the respective first and second nozzles are positioned at the second distance from one another during the filling.

20. The method according to claim 19, wherein the first distance is smaller than a first diameter of the cartridges of the first size, and wherein the second distance is smaller than a second diameter of the cartridges of the second size.

* * * * *